US010765916B2

(12) United States Patent
Hennemann et al.

(10) Patent No.: US 10,765,916 B2
(45) Date of Patent: Sep. 8, 2020

(54) SWIM SHOE

(71) Applicant: Raimund Hennemann, Christian Huber, Claudia Kemény, Flap Fin GbR, Baldham (DE)

(72) Inventors: Raimund Hennemann, Baldham (DE); Christian Huber, Munich (DE)

(73) Assignee: Raimund Hennemann, Christian Guber, Claudia Kemény, Flap Fin GbR, Baldham (DE)

( * ) Notice: Subject to any disclaimer, the term of this patent is extended or adjusted under 35 U.S.C. 154(b) by 0 days.

(21) Appl. No.: 16/094,960

(22) PCT Filed: Apr. 20, 2017

(86) PCT No.: PCT/EP2017/059346
§ 371 (c)(1),
(2) Date: Oct. 19, 2018

(87) PCT Pub. No.: WO2017/182550
PCT Pub. Date: Oct. 26, 2017

(65) Prior Publication Data

US 2019/0143177 A1 May 16, 2019

(30) Foreign Application Priority Data

Apr. 20, 2016 (DE) ..... 10 2016 107 359

(51) Int. Cl.
*A63B 31/00* (2006.01)
*A63B 31/11* (2006.01)

(52) U.S. Cl.
CPC ..... *A63B 31/11* (2013.01); *A63B 2031/117* (2013.01); *A63B 2208/03* (2013.01); *A63B 2209/00* (2013.01)

(58) Field of Classification Search
CPC . A63B 31/11; A63B 2208/03; A63B 2209/00; A63B 2031/117; A63B 31/00; A63B 2031/112
See application file for complete search history.

(56) References Cited

U.S. PATENT DOCUMENTS 1,011,964 A 12/1911 Jasper, Jr.
2,172,938 A 9/1939 Kahn
(Continued)

FOREIGN PATENT DOCUMENTS

CN 2601702 Y 2/2004
CN 101773721 A 7/2010
(Continued)

OTHER PUBLICATIONS

Search Report in DE Application No. 102016107359.8 dated Mar. 6, 2017, 14 pages.
(Continued)

*Primary Examiner* — Anthony D Wiest
(74) *Attorney, Agent, or Firm* — Marshall, Gerstein & Borun LLP

(57) ABSTRACT

A swimming shoe for learning and/or for supporting of the leg kick in breaststroke swimming is described. The swimming shoe has a shoe body and a sole flap connected thereto via a hinge coupling. The invention is characterized by the fact that the hinge coupling has a flexible strap through which the sole flap is connected with the shoe body, with the strap flexibly pressing the sole flap with pre-tensioning against a floor space of the shoe body.

21 Claims, 7 Drawing Sheets

(56) References Cited

U.S. PATENT DOCUMENTS

| | | | | | |
|---|---|---|---|---|---|
| 3,671,987 | A * | 6/1972 | Mayor | A43B 5/08 | 441/61 |
| 3,867,734 | A * | 2/1975 | Courageux | A63B 31/11 | 441/64 |
| 4,310,938 | A * | 1/1982 | Eichler | A63B 31/11 | 441/61 |
| 4,884,986 | A | 12/1989 | Gil | | |
| 6,866,615 | B2 * | 3/2005 | Ryland | A63B 31/11 | 441/64 |

FOREIGN PATENT DOCUMENTS

| | | | |
|---|---|---|---|
| DE | 2658584 | | 6/1978 |
| DE | 2658584 | A1 | 6/1978 |
| DE | 102007003508 | B3 | 7/2008 |
| DE | 102015101287 | B3 | 5/2016 |
| WO | WO-2010/123345 | A1 | 10/2010 |

OTHER PUBLICATIONS

Search Report and Written Opinion in International Application No. PCT/EP2017/059346 dated Jul. 4, 2017, 12 pages.
Office Action in CN Application No. 201780025107.3 dated Mar. 19, 2020, 15 pages.

* cited by examiner

SWIM SHOE

BACKGROUND OF THE INVENTION

Field of the Invention

This invention concerns a swimming shoe for learning and/or for support of the leg kick for breaststroke swimming and a swimming shoe production process.

Related Technology

Such swimming shoes are for example known from the documents DE 26 58 584 A1 and DE 10 2007 003 508 B3. They are used as swimming and learning aids, to make it easier to learn to swim, on the one hand, and also to practice as well to continually check for the correct breaststroke swimming technique, on the other hand.

These known swimming shoes have a sole flap, which can be swiveled to the outer side of the foot by means of a kind of hinge design. In the case of this shoe, the flap goes up when the stroke is executed, so that it becomes immediately noticeable whether the foot position is correct or not by way of the thereby increased kicking area of the feet. If the legs, more accurately said the lower legs, are drawn toward to the buttocks during the continued swimming movement, the flap swiveling with almost no resistance then closes because of the drag. In the subsequent rotary swinging movement until the legs stretch out, the flap opens up again, so that better propulsion comes about due to the increased repelling area of the feet. The person wearing the swimming shoe thus feels very soon while performing the breaststroke kick whether his foot position is correct or wrong. If the wearer of the swimming shoe gets different feedback signals from his left and his right swimming shoe, he can conclude very quickly that his left and his right legs do not move symmetrically, and he can immediately correct this.

Such swimming shoes have a good record in practice. With further development in accordance with DE 10 2007 003508 B3, a further improvement was achieved, in that an adjustment of the maximum swiveling angle of the sole flap was made possible so as to adjust the supporting effect of the swimming shoe in this way, and to allow for safe walking with the swimming shoe outside of the water. The hinge-like joint configuration provided by two textile straps in this known case, with one textile strap located at the inside of the hinge at the sole of the shoe body and the top of the sole flap and the other textile strap positioned at the outside of the hinge at a flap nose and at the side surface of the shoe body. The textile straps are, e.g., attached to the respective sections with a high-strength adhesive.

Aside from the fact that the known structure of the hinge joint design is relatively complex and that it is therefore more difficult to produce, it is found that, with prolonged use, the sole flap is not always reliably pressed against the soles because of the pre-tensioning of the joint. This known swimming shoe therefore has manually actuated fixer equipment, by means of which the sole flap is held parallel to the floor surface when walking outside the pool. This makes the construction of the swimming shoes slightly more elaborate.

SUMMARY

It is therefore the object of this invention to further develop a generic swimming shoe, such that it assures long term functionality with great ease of use by way of a simplified design.

According to the invention, an elastic strap is used, through which the sole flap is connected with the shoe body, whereby the strap presses the sole flap flexibly with pre-tensioning against the floor space of the shoe body. When the sole flap swivels away from the shoe body, the elastic strap stores energy in the form of a pre-tensioning force, which is used to swing the sole flap back onto the shoe body. With the strap pressing the sole flap against the floor space of the shoe body, this has the benefit that walking with the swimming shoe outside of the water is facilitated. This is because the flexible strap prevents the sole flap from unintentionally moving and/or swinging away. Without water resistance, the sole flap always rests against the floor space of the shoe body with sufficient pre-tensioning of the strap. The size of the strap can be varied over a wide range. This enables a robust construction of the swimming shoe of this invention, its long-term functionality being assured.

According to this invention, it is furthermore not necessary to provide any additional immobilization of the sole flap for walking outside of the water. This is because the sole flap always automatically rests against the floor space of the shoe body because of the pre-tensioning of the strap. According to this invention, the sole flap basically no longer requires a stop. For, because of the pre-tension, a sufficient feed force can be generated by way of the leg kick before a limiting swivel angle is reached.

This has the additional advantage that it remains economical to produce the swimming shoe. For the elastic strap can be produced either simply as an integral part of the shoe body or separately by an injection molding process.

In one embodiment, the entire length of the strap can be used to provide the joint function. The swiveling section swivels along with the sole flap because of the water resistance, and then presses the sole flap to the floor space of the shoe body with pre-tensioning. Such a simple construction enables the swiveling of the sole flap, while the size of the strap can influence the pre-tensioning force.

In another embodiment, the swivel angle is limited by the impact of the sole flap or the strap on the shoe body, but not by the elastic limit of the strap. This has the advantage that the strap does not reach its elastic limit and the service life of the strap is thus extended.

It is through the strap constituting an integral part of the shoe body that, the strap may be produced as part of the shoe body. This reduces the production effort as well as the cost.

In an embodiment, the strap is attached separately to the shoe body. This has the advantage that the strap and the shoe body can be made of different materials. The strap can, e.g., be made of a reinforced and possibly more expensive material so as to provide reliable functioning, while the shoe body can be made of an unreinforced and thus usually more economical material optimized for wearing comfort. This enables economical production.

The swivel section can be subdivided into several fastening tongues with different assigned functions. A further increase in the flexibility of the design is thus achieved.

The strap can may be successfully firmly connected with the sole flap since the fastening tongue is positioned in a sandwich-like manner between the bridge and the outer section the sole flap. The assembly is furthermore simplified, since the bridge controls the position of the strap and its attachment point. This additionally provides for a better appearance.

In an embodiment, the construction of the sole flap is simplified. It is through the interlacing of the fastening tongues of the strap into the sole flap that the link is stabilized.

In a further embodiment, the pre-tensioning tongue provides additional supporting force, which acts on the sole flap, so that it is possible to do without fastening the pre-tensioning tongue to the sole flap.

The sole flap may be installed and exchanged with the strap.

An embodiment, according to which numerous ribs are installed at the bottom of the sole flap, has the advantage that the sole flap is prevented from changing its shape when it is deflected or swings out. The ribs can, in addition, be given an anti-sliding function.

In an embodiment, the ribs preferably extend in the cross direction of the shoe body. With this direction of extension of the ribs the sole flap gets the rigidity required for supporting the leg kick, while it does not obstruct a rolling movement of the swimming shoe while running. User safety is therefore improved.

The weight of the sole flap can be reduced via the further development in an embodiment wherein the sole flap furthermore has two recesses at the outer section.

The strap does not necessarily have to have the same wall thickness everywhere. For example, a rib extending along the swiveling axis can be formed at the location between the swiveling and the non-swiveling section. This location can thus become heavier if the strap is in a bent condition. This location is therefore strengthened by the rib. Long-term functionality is therefore improved.

Experiments have shown that just one strap of a material may suffice to create sufficient pre-tensioning, with a strap thickness of 3 mm to 5 mm being sufficient. This offers the possibility of making the strap and the shoe bodies of one and the same material, preferably by injection molding.

If the shoe body is configured symmetrically so that it is symmetrical with respect to a longitudinal center axis, the swimming shoe can be produced economically, for example by injection molding. This is because only a single injection mold is needed for a pair of swimming shoes, for both the right shoe body and the left shoe body.

The production process in accordance with claim 18 enables may enable economic production. This is because the strap is, on the one hand, produced via the injection molding process as an integral part of the shoe body, and only one injection mold is needed for both shoe bodies, the right and the left shoe body, of a pair of swimming shoes. This results in economical production. If, on the other hand, the strap and the shoe body are produced separately by an injection molding process, they can be made of different materials. This production process as well requires only one shoe body, only one strap and —for the second embodiment with the interlaced fastening tongues —only one sole flap is required, which can be used for both shoes, the left shoe as well as the right shoe. This leads to an additional simplification of the production process.

BRIEF DESCRIPTION OF THE DRAWINGS

Example embodiments of the invention are hereinafter described in greater detail by means of schematic drawings, which show.

DETAILED DESCRIPTION

A swimming shoe, particularly the right swimming shoe, for learning and/or for support of the leg kick for breaststroke swimming is assigned the reference number 10 in the figures. No description of the left swimming shoe is provided here, since it is a mirror image of the right swimming shoe.

The swimming shoe is described in accordance with a first embodiment is hereinafter described with reference to FIGS. 1 to 7.

Figure 1:
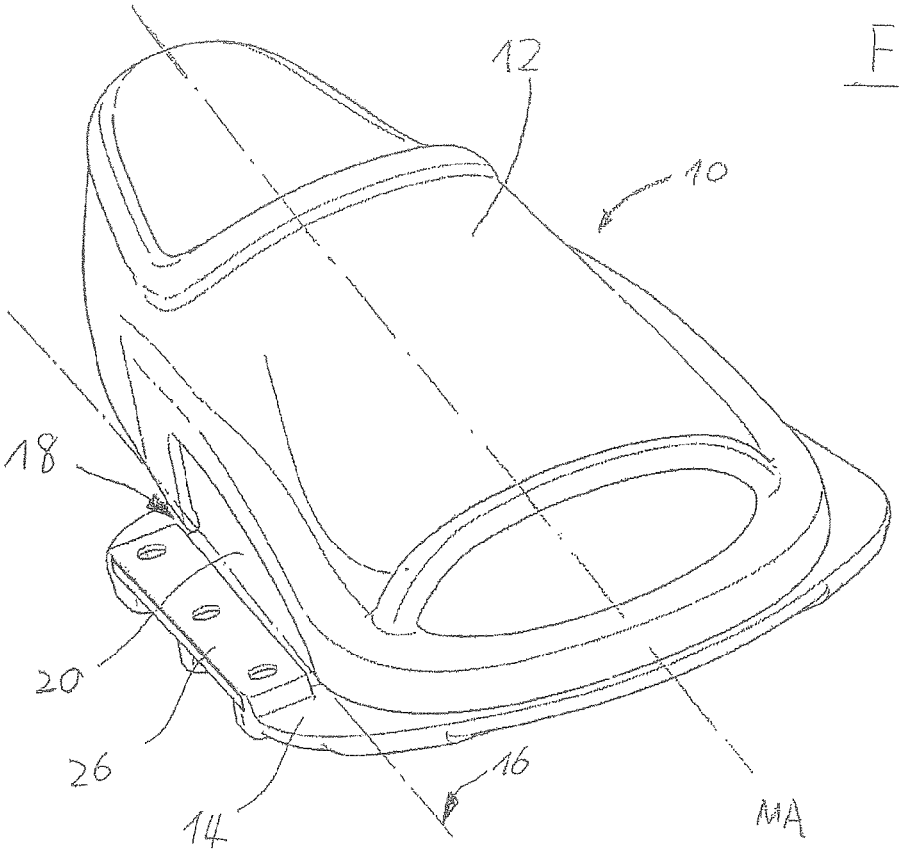
FIG. 1 a perspective view of a swimming shoe according to this invention for the right foot in accordance with a first embodiment.
Figure 6:
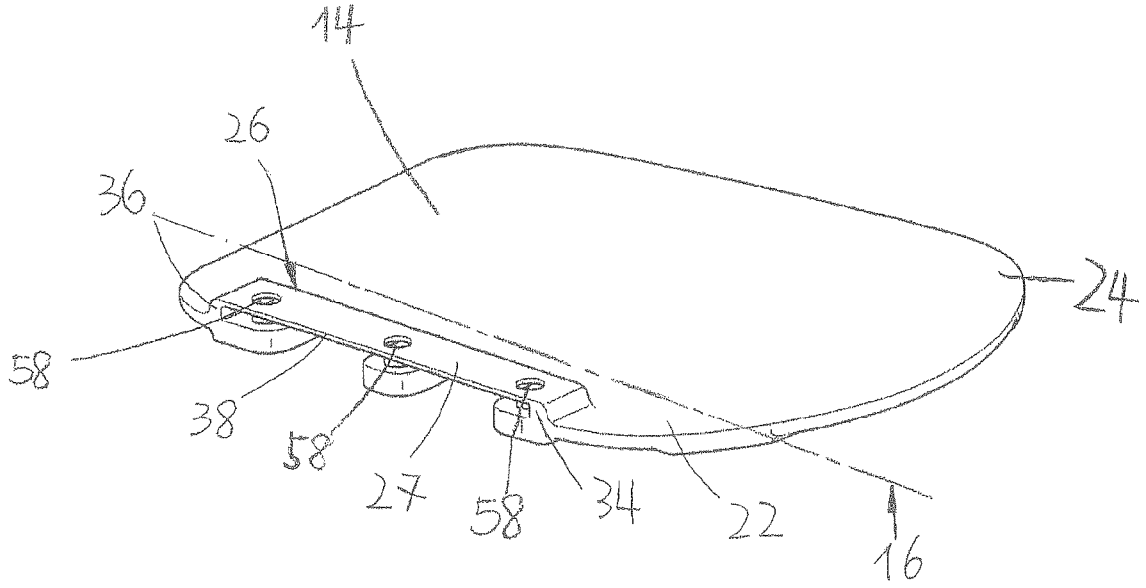
FIG. 6 a perspective view from a top side of a sole flap for a swimming shoe in accordance with the first embodiment.
Figure 7:
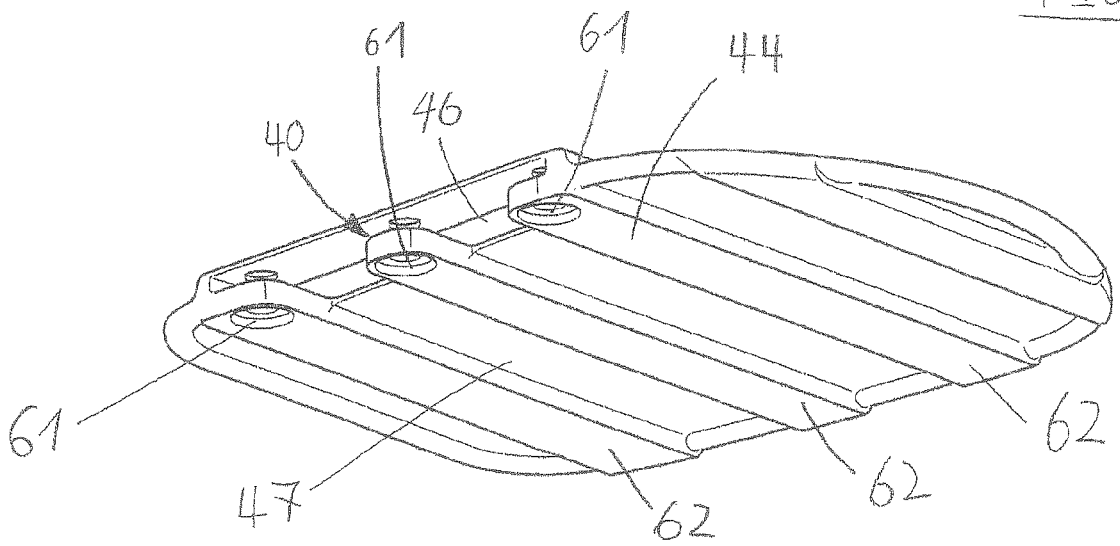
FIG. 7 a perspective view from the bottom of a sole flap of the swimming shoe in accordance with the first embodiment.

As shown in FIG. 1, the swimming shoe 10 mainly consists of two parts, i.e. the actual shoe body 12 and a sole flap 14 shown separately in FIGS. 6 and 7, which is attached thereto via a hinge coupling 18, which is to be described in greater detail. The hinge coupling 18 has an elastic strap 20 by means of which the sole flap 14 is connected with the shoe body 12, such that, through its elastic bending deformation, the strap 20 flexibly presses the sole flap 14 with pre-tension against a floor space 32 of the shoe body 12. When the swimming shoe is used as a swimming aid and/or as an aid in learning to swim, the flexible strap 20 builds up a pre-tension via additional elastic bending deformation when the sole flap 14 is swung away from the shoe body 12, and this pre-tension is used to swing the sole flap 14 back onto the shoe body.

In this embodiment, the strap 20 is produced as an integral part of the shoe body 12 by injection molding, i.e. it is molded onto the shoe body. The shoe body 12 with the strap 20 is made of a thermoplastic elastomer, preferably a thermoplastic elastomer based on urethane (TPU). The sole flap 14 is configured as a synthetic injection molded part.

Figure 5:
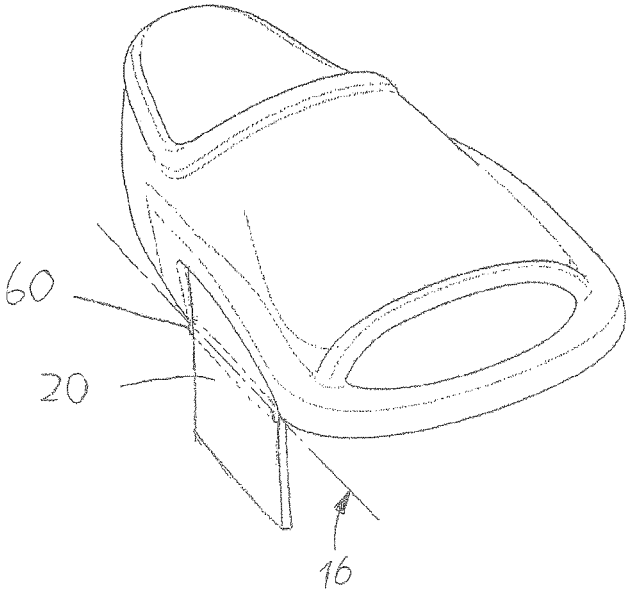
FIG. 5 a perspective view of a shoe body and a strap in the raw form in accordance with the first embodiment after it is taken out of an injection mold.

FIG. 5 shows the flexible strap 20 in a relaxed state, for example in the form in which it comes out of the injection mold together with the shoe body. The sole flap is not mounted yet. The strap is as yet unprocessed. In this relaxed state, a part of the flexible strap 20 projects over the floor space 32 of the shoe body 12.

Figure 3:
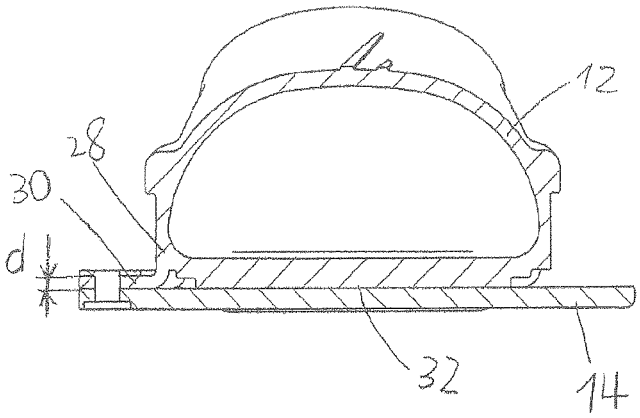
FIG. 3 the cross-section A-A in FIG. 2, wherein the nib is omitted.
Figure 4:
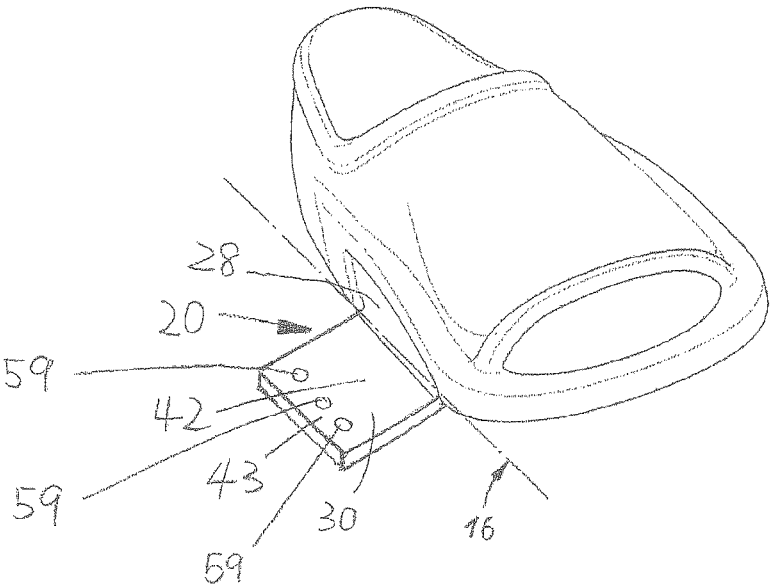
FIG. 4 a perspective view of a swimming shoe according to this invention in a mounted condition in accordance with the first embodiment, in which the sole flap is omitted.

As shown in FIGS. 3 and 4, the section of the strap 20 protruding above the floor space is bent outward in the mounted state of the sole flap and is connected with the sole flap 14. It is because of this elastic bending deformation of the strap 20 that a pre-tension builds up, through which the sole flap 14 is flexibly pressed against the floor space 32 of the shoe body 12. This projecting section of the strap 20 forms a swivel section 30, which can swivel along with the sole flap 14 due to water resistance when kicking. The section protruding over the floor space 32 forms a not swiveling or non-swiveling section 28, which is connected with the shoe body 12. A swivel axis 16 of the hinge coupling 18 lies between the swiveling section 30 and the non-swiveling section 28. The entire length of the strap can thus be used for providing the hinge function.

The strap 20 in the form of a piece of cloth has a uniform wall thickness and—depending on the material—a thickness din the range of 3 mm to 5 mm. It can be shown in experiments that long-term functionality can be ensured.

The strap does not necessarily have to be made with same wall thickness everywhere. A reinforcing ridge 60, which extends along the swivel axis 16 (this alternative is shown with cross-hatches in FIG. 5), can, for example, be placed between the swiveling section 30 and the non-swiveling section 28).

Figure 2:
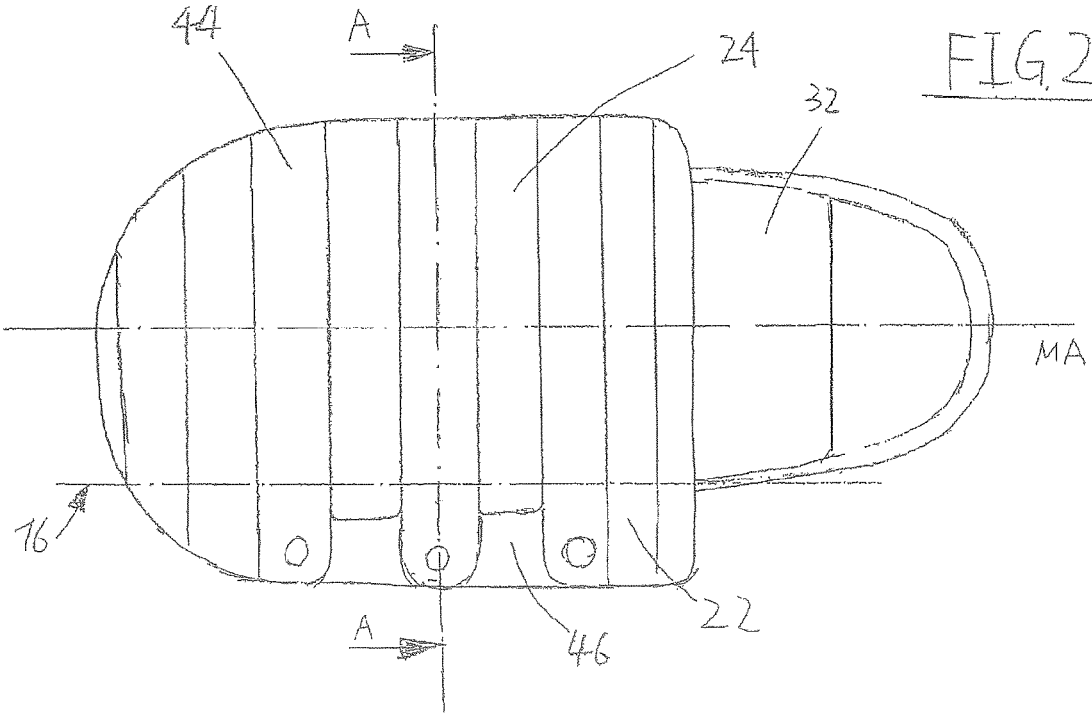
FIG. 2 a view from below of the swimming shoe in accordance with the first embodiment.

FIG. 2 shows a view of the swimming shoe 10 in accordance with the first embodiment as seen from below. The sole flap 14 has an outer section 22 to which the swiveling section 30 of the strap 20 is fastened and an inner section 24, which rests against the floor space 32 of the shoe body 12 when it is at rest. The sections 22 and 24 are separated from each other by the swivel axis 16.

The nature of the connection between the strap 20 and the sole flap 14 in accordance with the first embodiment is hereinafter described in greater detail.

As shown best by FIGS. 6 and 7, the sole flap 14 has a bridge 26, which projects upward from the sole flap 14 and contains a first end section 34, a second end section 36 and a base plate 38, whereby a slot 40 is formed between the bridge 26 and the outer section 22, into which the swivelable section 30 of the strap 20 can be introduced as a fastening tongue 42, as shown in FIGS. 3 and 4.

To fasten the sole flap 14, the fastening tongue 42 is inserted into the slot 40 from inside. The outer contour of the fastening tongue 42 thus follows the contour of the slot 40. The fastening tongue 42 and thus the strap 20 can be detachably connected to the sole flap 14. In the embodiment shown, there are three drilled cutouts and/or drill holes 58 in the base plate 38 of the bridge 26 of the sole flap 14, three drilled cutouts and/or drill holes 61 in the outer section 22 of the sole flap 14 and three drilled cutouts and/or drill holes 59 in an end section 43 of the fastening tongue 42 of the strap 20, which are mutually aligned and can be respectively introduced into a nib and/or a stud. The cutouts 58, 59, 61 are aligned with each other regarding their position, such that as shown in FIG. 3 the sole flap 14 lies flat on the floor space 32. The three connecting points are essentially located along the longitudinal direction of the swimming shoe 10. The strap 20 is thus positioned by the bridge 26 and is attached to the sole flap 14 in a sandwich-like manner.

FIG. 3 shows the state of the swimming shoe 10 with the mounted sole flap 14. One can see that the sole flap 14 is pressed against the floor space 32 of the shoe body 12 by pre-tension, with the swiveling section 30 of the strap 20 bent outward at about 90°. The sole flap 14 can also jut out slightly beyond the floor space on the side opposite the hinge configuration. If the leg kick is performed correctly, the sole flap goes up because of the water resistance. As long as the water pressure is higher than the pre-tensioned force of the strap 20, the water is pushed into the space between the sole flap 14 and the floor space 32 of the swimming shoe 10, whereby the sole flap 14 is pushed to about 90° by the water resistance and a topside 27 of the bridge 26 strikes the sidewall of the shoe body 12. When the legs, more accurately the shanks, are pulled toward the buttocks, the sole flap 14, which essentially experiences no resistance, closes because of the drag and the pre-stressed state of the strap 20, while the water is displaced from the space between the sole flap 14 and the floor space 32 of the swimming shoe 12. The sole flap 14 is again opened up during the subsequent rotary swinging movement until the legs stretch out. The swimmer thus feels very soon whether his foot position is correct or wrong.

The sole flap 14 according to this embodiment furthermore has numerous ribs 44. These ribs 44 are located at the bottom 47 of the sole flap 14 and extend across the longitudinal axis of the shoe body 12. Selected ribs 62 of the ribs 44 extend through the three junction points. When the swimmer wears the swimming shoes and walks outside of the water, the sole flap with pre-tensioning of the strap rests against the floor space of the shoe body. The pre-tensioning of the strap and the ribs extending in the transverse direction prevent the sole flap from unintentionally moving and/or swinging out, while a rolling motion of the swimming shoe is not obstructed because the ribs extend in the transverse direction.

As shown in FIG. 2, the outer section 22 of the sole flap 14 furthermore has two recesses 46, which are located under the bridge 26 between the three ribs 62 extending through the three junction points.

As can be concluded best from FIG. 3, the shoe body 12 is designed so that it is symmetrical with respect to a longitudinal center axis MA. This makes it possible to use an identical injection molding tool for a left and a right swimming shoe.

The details provided hereinafter refer to the FIGS. 8 to 12 of the swimming shoe in accordance with the second embodiment. For purposes of simplifying the description, those components that correspond to the components of the first embodiment are assigned similar reference numbers, which are however prefixed by "1".

Figure 8:
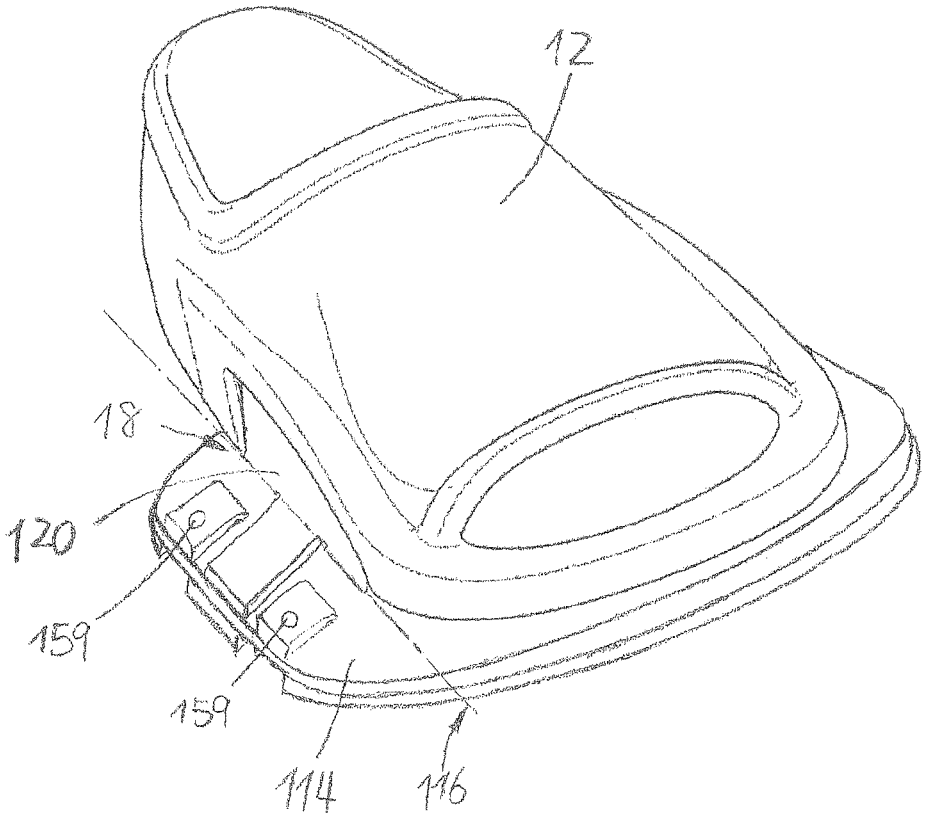
FIG. 8 a perspective view of a swimming shoe for the right foot in accordance with a second embodiment.

FIG. 8 shows a perspective view of a swimming shoe 10 for the right foot in accordance with a second embodiment. As shown in FIG. 8, the swimming shoe 10 mainly consists of two parts, i.e. the actual shoe body 12 and a sole flap 114 shown separately in FIG. 12, which is connected with the shoe body 12 via a hinge coupling 18 still to be described in greater detail. The hinge coupling 18 has a flexible strap 120 by means of which the sole flap 114 is connected with the shoe body 12, with the strap 120 flexibly pressing the sole flap 114 with pre-tension against a floor space 32 of the shoe body 12.

In this embodiment, the strap 120 is again produced by injection molding as an integral part of the shoe body 12. The shoe body 12 with the strap 120 is made of a thermoplastic elastomer, preferably a thermoplastic elastomer based on urethane (TPU). The sole flap is a synthetic injection molded part.

Figure 10:
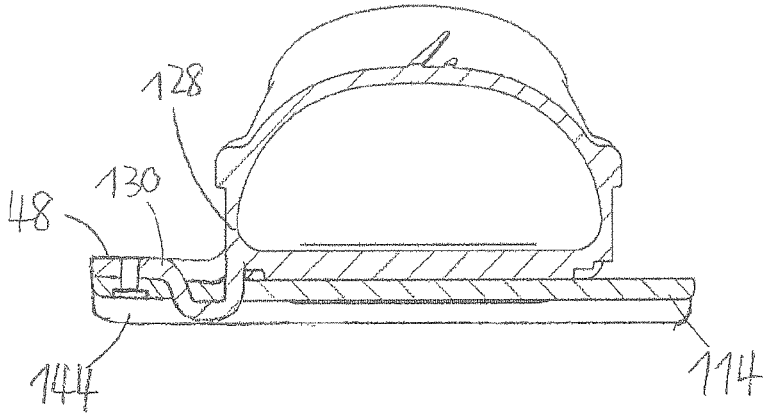
FIG. 10 the cross-section B-B in FIG. 9.

As shown in FIGS. 8 and 10, the section of the strap 120 projecting over the floor space is bent outward in the mounted state of the sole flap and is connected with the sole flap 114. This is the swiveling section 130, which can swivel with the leg kick along with the sole flap 114 due to water resistance. The section that does not project over the floor space 32 constitutes a not swiveling and/or non-swiveling section 128, which is connected with the shoe body 12. A swivel axis 116 of the hinge coupling 18 lies between the swiveling section 130 and the not-swiveling section 128. The entire length of the strap can thus be used to provide the hinge function.

The strap 120 made of a piece of cloth has a uniform wall thickness and—depending on the material—a thickness din the range of 3 mm to 5 mm.

Figure 9:
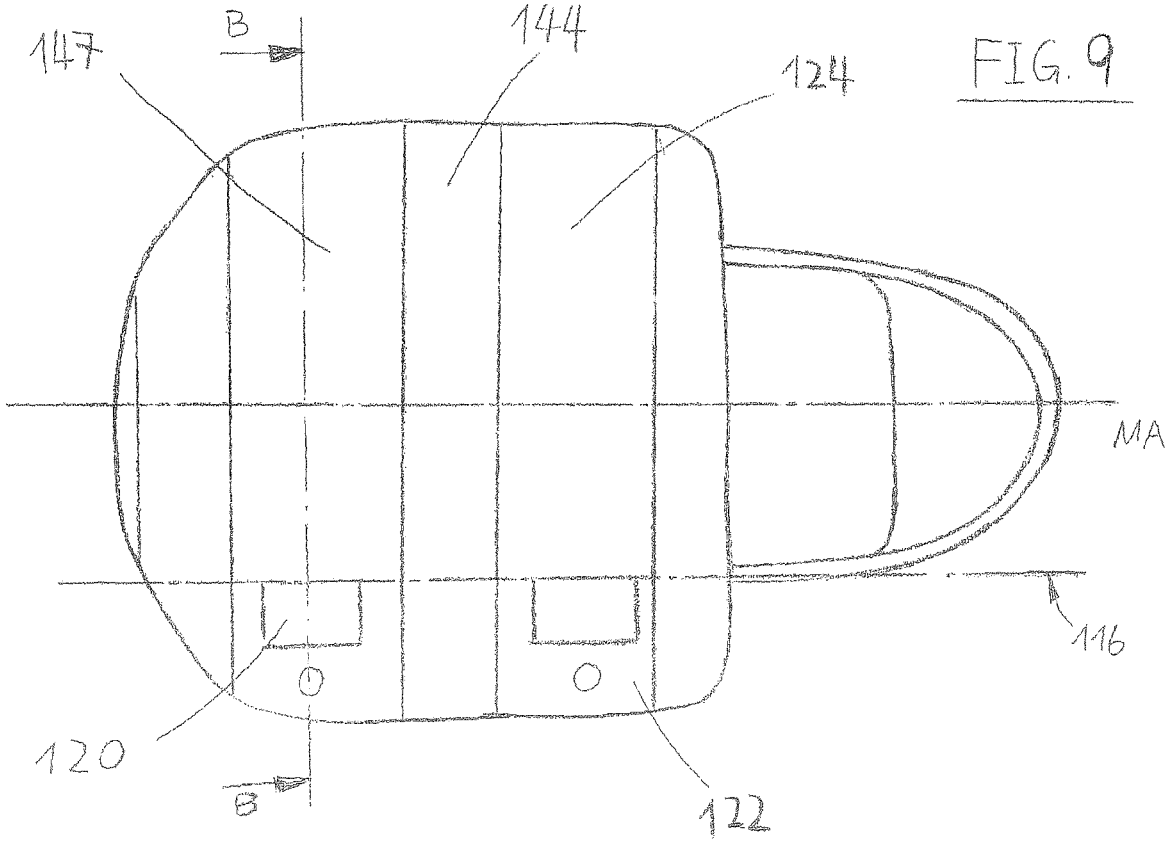
FIG. 9 a view from the bottom of the swimming shoe in accordance with the second embodiment.

FIG. 9 shows a view of the swimming shoe 10 in accordance with the second embodiment as seen from below. The sole flap 114 has an outer section 122, to which the swiveling section 130 of the strap 120 is attached, and an inner section 124, which rests against the floor space 32 of the shoe body 12 when it is at rest. The sections 122 and 124 are separated from each other by the swivel axis 116.

The nature of the connection between the strap 120 and the sole flap 114 in accordance with the second embodiment is described in greater detail below.

Figure 12:
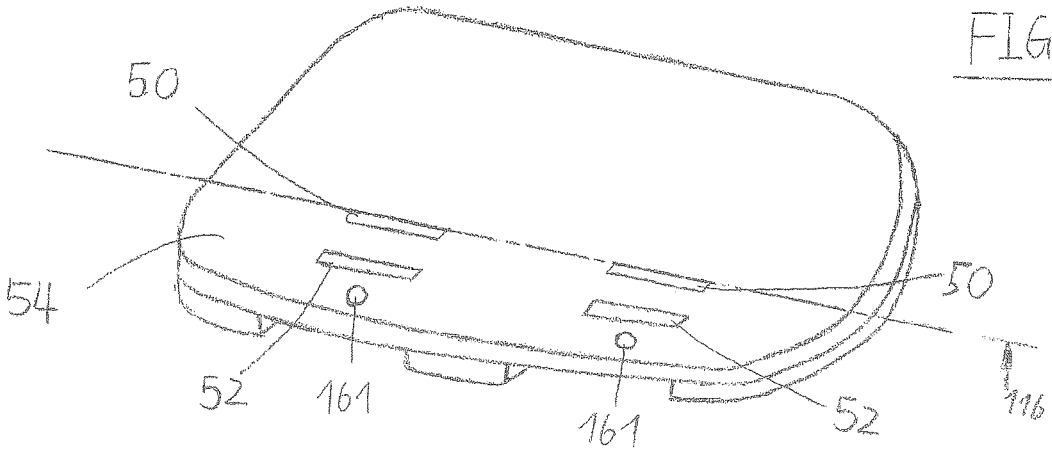
FIG. 12 a perspective view from a top side of a sole flap for the swimming shoe in accordance with the second embodiment.

As shown in FIG. 12, the sole flap 114 has two rows of long holes, which respectively contain an inner oblong hole 50 and an outer oblong hole 52 in the transverse direction of the longitudinal direction of the shoe body. The swiveling section 130 of the strap 120 furthermore has two fastening tongues 142.

The fastening tongue 142 is laced into the long holes so as to fasten the sole flap. More accurately, the fastening tongues 142 are respectively inserted from above into the appropriate inner long hole 50 and then from below into the corresponding outer long hole 52. The fastening tongues 142 and thus the strap 120 can be loosely connected with the sole flap 114. In the embodiment shown here, there are two drilled cutouts and/or drilled holes 161 on the outer section 122 of the sole flap 114 and two drilled cutouts and/or drilled holes 159 at an end section 143 of the fastening tongue 142 of the strap 120, which are mutually aligned and can be respectively introduced into a nib and/or a stud. The cutouts 159, 161 are aligned with each other regarding their position, such that—as shown in FIG. 10—the sole flap 114 lies flat on the floor space 32. The two connecting points are essentially located along the longitudinal direction of the swimming shoe 10.

The resistance of the water can push the sole flap 114 along with the swiveling section 130 of the strap 120 to an angle of at most 90°, until a top side 48 of the end section 143 of the fastening tongue 142 strikes the shoe body 12.

The swiveling section 130 furthermore has a pre-tensioning tongue 56. The pre-tensioning tongue 56 is located between the two fastening tongues 142 and rests under bending pre-stress in a mounted state of the sole flap 114 against the top side 54 of the outer section 122 of the sole flap 114. It is possible to do without fastening the pre-tensioning tongue 56 to the sole flap 114.

In accordance with the embodiment shown here, the sole flap 114 furthermore has numerous ribs 144. These ribs 144 are located at the bottom 147 of the sole flap 114 and extend across the longitudinal axis of the shoe body 12.

As can best be concluded from FIG. 10, the shoe body 12 is positioned symmetrically with respect to a longitudinal center axis MA. It is in this way that it is possible to use the same injection molding tool for a left and a right swimming shoe.

A variant of the sole flap in accordance with FIGS. 8 to 12 is hereinafter described in greater detail with reference to the FIGS. 13 and 14. For purposes of simplifying the description, those components that correspond to the components of the previously described second embodiment are assigned similar reference numbers in which the prefix "1" is replaced by "2".

Figure 11:
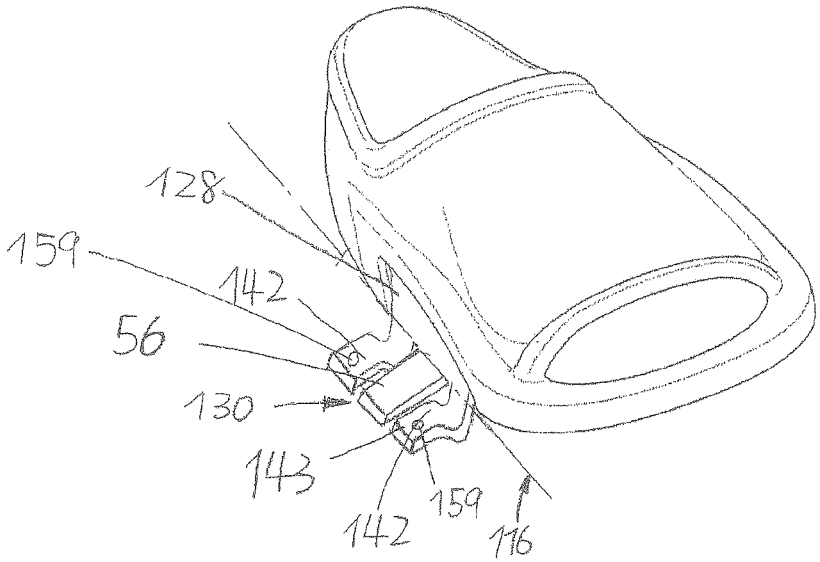
FIG. 11 a perspective view of a swimming shoe according to this invention in a mounted condition in accordance with the second embodiment, in which the sole flap is omitted.

Deviating from the embodiment according to FIGS. 8 to 12, the sole flap 214, which is preferably designed as an injection molded part, has a cutout 253, over the approximate center of which a bridge 255 extends, in place of the long holes 50, 52. The fastening tongues 142 not shown in greater detail and forming the outer strap segments can thus—as shown in FIGS. 10 and 11—be woven into the sole flap 214. The reference number 261 refers to cutouts, which serve the purpose of taking up rivets by means of which the woven-in fastening tongues are connected with the sole flap 214. The reference number 263 refers to a cutout for producing of a further riveted joint with the pre-tensioned tongue 56, which takes care of an additional pre-tensioning force for pressing the sole flap against the floor space of the shoe body under flexible elastic pre-tension.

In further deviation from the embodiment according to FIGS. 8 to 12, the ribs 244 are installed on the side of the sole flap 214 facing the shoe body. A fixing flap 270 serving a cutout 272 for receiving a pushbutton connecting element not shown, with which the sole flap 214 can be affixed so that it is separable from the shoe body when the hinge function is deactivated is lastly fitted onto the sole flap 214 on the side opposite to the cutouts 253. In this way, the sole flap can additionally be affixed to the shoe body by means of a separate holding device if the shoe is to be used outside of the water. The pushbutton connection can, for example, be implemented in a manner such as that, e.g., shown in FIG. 8 of the German patent DE 2007 003508 B3 or as described in the older German patent application DE 10 2015 101287 with reference to the FIGS. 1 to 7. The disclosure in these older patent applications of relevance here likewise becomes the subject of the present application by reference.

Figure 13:
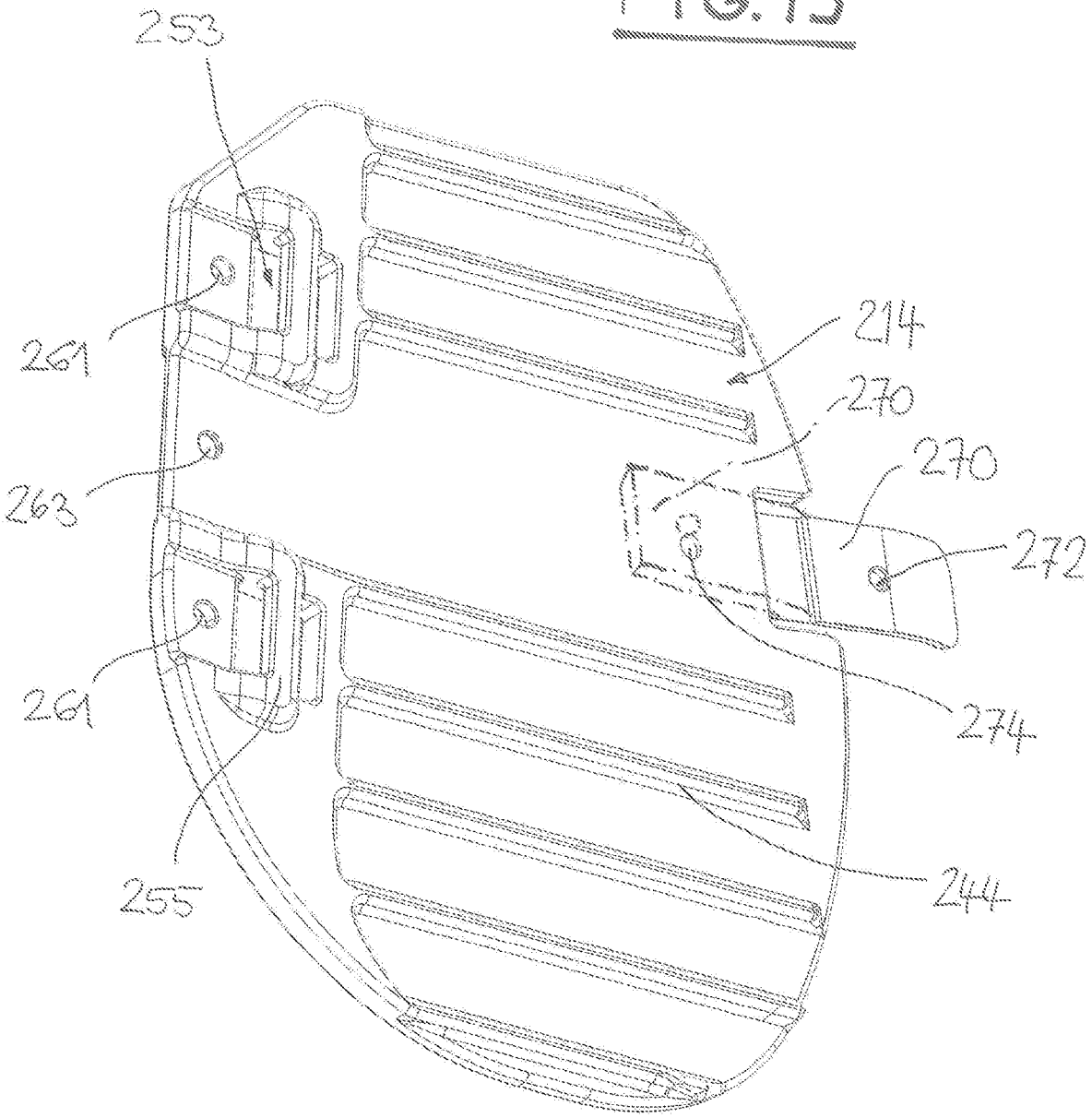
FIG. 13 a perspective view of an alternative of the second embodiment of the sole flap similar to FIG. 12 at a somewhat magnified scale.
Figure 14:
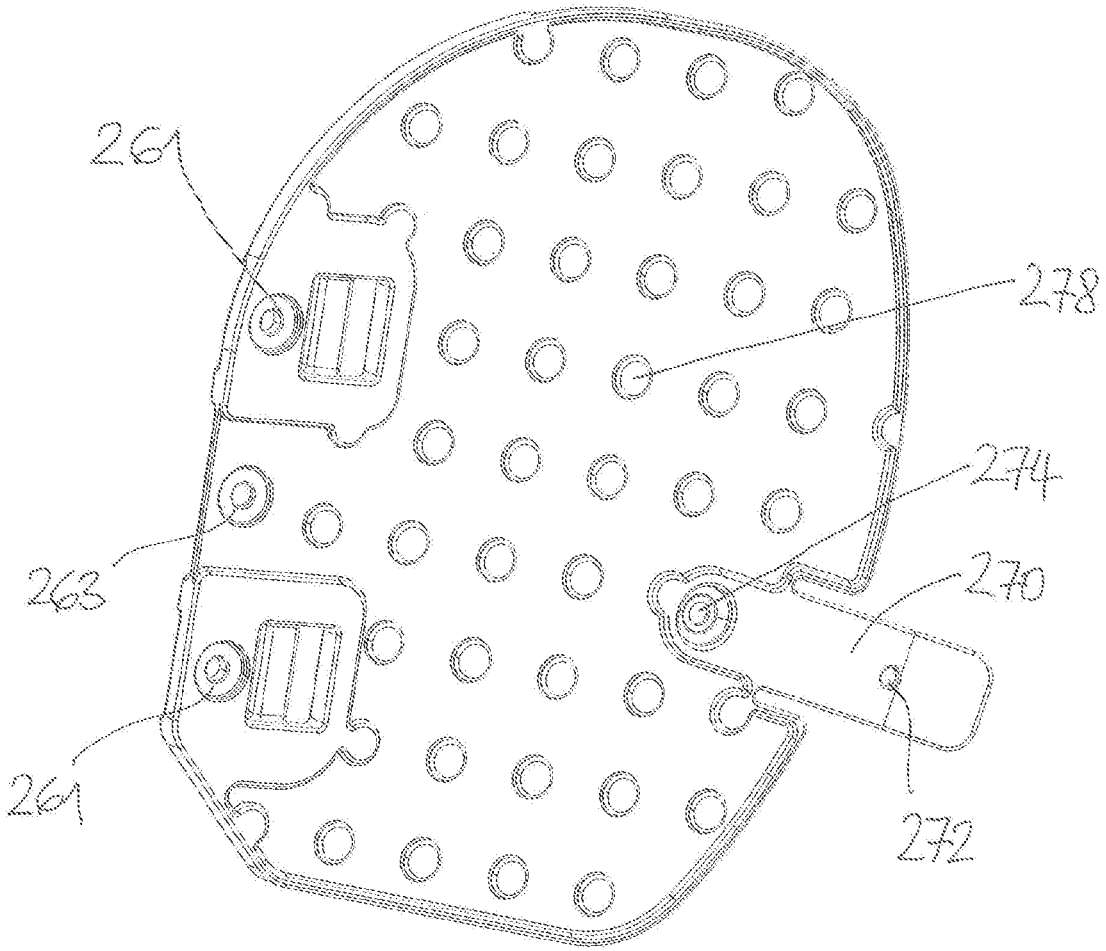
FIG. 14 the perspective view of the sole flap in accordance with FIG. 13 as seen from below.

The strap 270 can be stowed away to save space in the "swimming mode", which is suggested by the dash-dotted line in FIG. 13. A pushbutton connection, for which a cutout 274 is provided in the sole body 214, can be used in this case as well. This configuration is achieved in that the folded up strap 270', which is fixed in place via the pushbutton connection, does not extend over the ribs 244, and in that the pushbutton connecting components also do not extend over the ribs, so that the sole flap 214 is pressed against the floor area of the shoe body without any gap, and neither the strap 270 nor the push-button connection is felt when walking with the shoe.

It can be deduced from the view of the sole flap 214 from below in accordance with FIG. 14 that the bottom has numerous nubs 278, which provide for a skid-proof hold when walking with the swimming shoe. It is furthermore evident that the cutouts 261, 263 and 274 are configured so that the pushbutton connecting components can be taken up in the sole body 214 in a positive locking and as far as possible recessed manner so that they do not show and do not impair the function of the sole flap 214.

Experiments have shown that the construction of the swimming shoe of this invention with both embodiments ensures that heretofore unachievable long term functionality can be achieved via good user friendliness. In other words, the function supporting the leg kick of the person learning to perform the breast stroke is sustained for the long term via the simplified construction of the flexible strap. The swimming shoe can, at the same time, be kept relatively small, and the production of the swimming shoe is further simplified compared with past solutions. Due to the construction of the hinge design with the flexible strap, the sole flap in the non-swiveled condition remains safely in a neutral position near the shoe body, even when walking outside of the water, so that the hinge is treated with care and the risk of falling is reduced. The swimming shoe is lastly characterized by being comfortable to wear, particularly when walking with the swimming shoes on.

The production of the swimming shoe is described below.

In the first step, the shoe body (12) that is integrated with a left strap and a right strap, which respectively extend over a floor space (32) of a shoe body (12) with a swivel section (30; 130), is preferably produced by an injection molding process. As an alternative to the first step, the shoe body (12) can be produced with identical fastening sections for the separate strap (20; 120) on both of its sides, preferably by the injection molding process. The left strap or the right strap is cut off in the second step. As an alternative to the second step, the separate strap (20; 120) can be attached to the fastening section of the shoe body (12). At the end, the sole flap (14; 114) is attached to the swiveling section (30; 130), in that it is bent outward. The swimming shoe of this invention can be produced by this simplified production process.

Modifications of the embodiments shown are of course possible without departing from the basic concept of this invention.

The long-term functionality can be improved by different modifications based on the first embodiment. The material TPU can thus be replaced with other materials having similar physical characteristics.

The flexible strap also does not have to be of one piece with the shoe body. The non-swiveling section of the strap can, for example, be attached to the shoe body via a separable connection. The production process can accordingly be varied. The swimming shoe thus consists of three parts, i.e. of a shoe body, a strap and a sole flap, which can be used for both shoes, the left shoe and the right shoe.

An additional strap whose length is adjustable can, for example, be used for fastening the sole flap as described with reference to the FIGS. 6, 7, 9 and 10 of the German patent DE 2007 003508 B3. The relevant disclosure of the German patent DE 2007 003508 B3 is hereby expressly referred to in the present application.

The pin-like connection between the strap and the sole flap can also be established by means of an adhesive or a pushbutton connection.

The number of connecting points can of course also be varied.

It is possible to vary the number of rows of long holes and the number of fastening tongues based on the second embodiment. A row of long holes and fastening tongues or several sets of long holes and several fastening tongues can accordingly be installed. The number of pre-tensioning tongues can be also varied and can be zero or more than two.

The position of the strap can also be varied. In the embodiments described above the strap is located on the side wall of the shoe body. The strap can also be located within the side wall of the shoe body.

The invention claimed is:

1. Swimming shoe for learning the leg kick and/or for support of breaststroke swimming, with a shoe body and a sole flap connected to the shoe body via a lateral hinge coupling, wherein the hinge coupling comprises a flexible strap, the flexible strap including a non-swiveling section attached to the shoe body and a swiveling section protruding below a floor space of the shoe body when the strap is in a relaxed state by which the strap, after being elastically bent outwardly at about 90°, detachably connects the sole flap with the shoe body, with the strap flexibly pressing the sole flap under pre-tension to a floor space of the shoe body.

2. Swimming shoe according to claim 1, wherein the strap has a swivel axis located between the swiveling section and the non-swiveling section, the swivel axis extending essentially in a longitudinal direction of the shoe body; and wherein the sole flap has an outer section and an inner section, wherein the outer section is attached to the swiveling section of the strap and the inner section and the outer section lie on opposite sides of the swivel axis when the sole flap is pre-tensioned against the floor space of the shoe body.

3. Swimming shoe according to claim 2, wherein the non-swiveling section of the strap is attached to the shoe body.

4. Swimming shoe according to claim 2, wherein the swiveling section of the strap has at least one fastening tongue.

5. Swimming shoe according to claim 4, wherein the sole flap additionally has a bridge, whereby a slot is formed between the outer section and the bridge, into which slot the at least one fastening tongue of the swiveling section of the curved strap can be inserted.

6. Swimming shoe according to claim 5, wherein the sole flap furthermore has two recesses at the outer section.

7. Swimming shoe according to claim 5, wherein the strap has a ridge, which extends along the swivel axis between the swiveling section and the non-swiveling section.

8. Swimming shoe according to claim 4, wherein the sole flap has at least one row of long holes, which contains an inner long hole and an outer long hole across the longitudinal direction of the shoe body, with the at least one siPgl-e fastening tongue of the swiveling section being interlaced with the long holes.

9. Swimming shoe according to claim 8, wherein the swiveling section furthermore has at least one pre-tensioned tongue, which rests under bending pre-tension against a top side of the outer section of the sole flap.

10. Swimming shoe according claim 8, wherein the at least one fastening tongue is inserted from above into the inner long hole and then from below into the outer long hole.

11. Swimming shoe according to claim 2, wherein the swiveling section of the strap is detachably connected with the outer section of the sole flap.

12. Swimming shoe according to claim 2, wherein a plurality of ribs are installed at a bottom of the sole flap.

13. Swimming shoe according to claim 12, wherein the ribs extend in a crosswise direction of the shoe body.

14. Swimming shoe according to claim 1, wherein the strap is an integral part of the shoe body.

15. Swimming shoe according to claim 1, wherein the strap is made of a thermoplastic elastomer.

16. Swimming shoe according claim 15, wherein the strap is made of a thermoplastic elastomer based on urethane (TPU).

17. Swimming shoe according to claim 1, wherein the strap has a thickness of 3 mm to 5 mm.

18. Swimming shoe according to claim 1, wherein the shoe body is aligned symmetrically with respect to a longitudinal central axis.

19. Method for producing a swimming shoe according to claim 1, wherein the method comprises the following steps:

a1) molding the shoe body with a left strap and a right strap which respectively protrude with a swiveling section over the floor space of the shoe body, and cutting off the left strap or the right strap; or a2) molding a shoe body with identical fastening sections for a separate strap on both sides of the shoe body, and attaching a said separate strap to a fastening section of the shoe body so as to protrude with the swiveling section over the floor space of the shoe body; and b) attaching the sole flap to the swiveling section by bending the swiveling section outwardly at about 90°.

20. Swimming shoe according to claim 1, wherein the strap is molded onto the shoe body.

21. Swimming shoe according to claim 1, wherein the non-swiveling section of the strap is attached to the shoe body via a separable connection.

* * * * *